US006041449A

United States Patent [19]

Brown et al.

[11] Patent Number: 6,041,449

[45] Date of Patent: Mar. 28, 2000

[54] APPARATUS AND METHOD FOR TREATING OBJECTIONABLE ODORS IN TOILET BOWLS AND THE LIKE

[76] Inventors: Christopher L. Brown, 1810 Broad Ripple Ave., 12A, Indianapolis, Ind. 46220; Daniel E. Julian, 8050 Niwot Rd. #12, Niwot, Colo. 80503; Nancy J. Rasche, 2124 Hannah Ct., Lebanon, Ind. 46052; Gary Lee Brown, H.C.R. 61 Box 514, MillCreek, Pa. 17060; Sydney Wayne Floyd, 152 Pipe Plant Rd., Pine Hall, N.C. 27042

[21] Appl. No.: 09/244,248

[22] Filed: Feb. 3, 1999

[51] Int. Cl.[7] ..... E03D 9/04

[52] U.S. Cl. ..... 4/213; 4/216; 4/217; 4/222

[58] Field of Search ..... 4/213, 216, 217, 4/222

[56] References Cited

FOREIGN PATENT DOCUMENTS 0331192 9/1989 United Kingdom ..... 4/213

*Primary Examiner*—Steven O. Douglas
*Assistant Examiner*—Khoa Huynh
*Attorney, Agent, or Firm*—Woodard, Emhardt, Naughton Moriarty & McNett

[57] ABSTRACT

An apparatus for treating objectionable odors from a toilet bowl, where the toilet bowl includes a seat positioned above the toilet bowl, comprises a main body having an inlet opening, an outlet opening and a scent delivery chamber; an apparatus for mounting the main body proximal to the toilet bowl with the inlet opening positioned substantially between the bowl and the seat; a drawer removabley securable to the main body; a fan for drawing gas in the inlet opening, through the scent delivery chamber and out the outlet opening; a power source; a switch for electrically connecting the power source to the fan; a scent delivery device positioned within the scent delivery chamber for releasing a scent at least when the fan is drawing gas through the scent delivery chamber; a tree sized and shaped to hold the scent delivery device within the scent delivery chamber; and, wherein the drawer includes a closed condition securing the scent delivery device within the scent delivery chamber, and an open condition exposing and enabling removal of the scent delivery device.

20 Claims, 8 Drawing Sheets

APPARATUS AND METHOD FOR TREATING OBJECTIONABLE ODORS IN TOILET BOWLS AND THE LIKE

FIELD OF THE INVENTION

The present invention relates to the field of air treatment devices, and particularly to devices for eradicating objectionable odors from toilet bowls and the like.

BACKGROUND OF THE INVENTION

Until the early 1800's, Europeans and Americans alike relieved themselves in chamber pots, outhouses and alleyways. Eventually, however, indoor plumbing became the standard. In America, the first city with modern waterworks was Philadelphia in 1820; the first city with a modem sewage system was Boston in 1823; and, the first toilet installed in the White House was in 1825 for John Quincy Adams.

A major contributor to the advancement of indoor toilet technology was an Englishman named Thomas Crapper. Through his plumbing fixture company, T. Crapper & Co, Chelsea, London, founded 1861, Mr. Crapper produced many improvements in the fixtures he manufactured. Crapper's name was stenciled on all the cisterns—and later, toilets—that he manufactured. It is likely because of his contributions that he is often accredited with the invention of the toilet. However, it was another Englishman named Alexander Cumming who in 1775 made perhaps the most significant improvement to the indoor toilet. While toilets to that day had emptied directly into a pipe which carried the waste to a cesspool, Cumming improved the device by adding a "stink trap" that kept water in the pipe, thus blocking the backflow of sewage gases. Absent the constant foul-smelling stench of sewer gases wafting through pipes and up into the house, the indoor toilet became an acceptable, and welcomed improvement.

While Cumming's invention addressed foul smelling gases downstream of the stink trap, treating objectionable odors developed in the toilet bowl itself has proven to be a formidable challenge. Many methods have been employed for treating and/or eliminating such odors, such as opening a window, lighting a match, spraying an aerosol deodorizer, and using a range of powered devices. The most common of such devices, the ceiling fan, is often difficult to install, requires ducting to the outside or attic, and has a flow rate that is generally too low to evacuate the odors as fast as most users would like.

One line of development for bathroom odor treatment devices encompasses devices mounted proximal to the toilet bowl and activated to draw the objectionable gases into a chamber, treat them and then exhaust them back to the bathroom area. A number of these and similar devices are disclosed in the following U.S. Patents:

| U.S. Pat. No. | Inventor |
|---|---|
| 5,727,262 | Littlejohn |
| 5,555,572 | Hunnicutt, Jr. |
| 5,519,897 | DeSimone |
| 5,488,741 | Hunnicutt, Jr. |
| %,416,930 | Waldner, et al. |
| 5,403,548 | Aibe, et al. |
| 5,240,653 | Ramkissoon |
| 5,161,262 | Quaintance, Sr. |

-continued

| U.S. Pat. No. | Inventor |
|---|---|
| 4,876,748 | Chun |
| 4,748,698 | Kao |
| 4,472,841 | Faulkner |
| 4,317,242 | Stamper |
| 4,099,047 | Kirkland, Jr. |
| 3,857,119 | Hunnicutt, Jr. |
| 2,846,696 | J.R. Herriott |

While devices disclosed in these patents exhibit a variety of beneficial features for treating and/or evacuating foul odors from a bathroom facility, they also suffer from a variety of drawbacks. For example, the devices disclosed in U.S. Pat. Nos. 4,876,748 and 5,727,262 are quite large and unsightly. Other of these patents describe devices that appear to draw the malodorous gases through some type of filter (U.S. Pat. Nos. 4,317,242, 5,488,741 and 5,555,572) or that draw the gases over a heating device before expelling them back into the air (U.S. Pat. Nos. 4,099,047 and 5,519,897). Further, many of such devices are fairly complex and therefore costly. It is believed that none of these devices achieves an acceptable balance among low consumer cost, ease of use, ease of maintenance, and most importantly, speed and effectiveness of use.

SUMMARY OF THE INVENTION

Generally speaking, there is provided an apparatus for treating and eradicating objectionable odors from toilet bowls and the like. The device is small, easy to use and maintain, and operates in a fast and efficient manner. Moreover, it may be used with a variety of commercially available products to treat and replace the objectionable odors with a wide range of pleasant aromas.

An apparatus for treating objectionable odors from a toilet bowl, where the toilet bowl includes a seat positioned above the toilet bowl, comprising a main body having an inlet opening, an outlet opening and a scent delivery chamber; means for mounting the main body proximal to the toilet bowl with the inlet opening positioned substantially between the bowl and the seat; a drawer removably securable to the main body; fan means for drawing gas in the inlet opening, through the scent delivery chamber and out the outlet opening; a power source; switch means wired with the fan means and the power means and engagable with the toilet seat to electrically connect the power source to the fan means upon downward pressure being applied to the toilet seat relative to the toilet bowl; scent delivery means positioned within the scent delivery chamber for releasing a scent at least when the fan means is drawing gas through the scent delivery chamber; and, wherein the drawer includes a closed condition securing the scent delivery means within the scent delivery chamber, and an open condition exposing and enabling removal of the scent delivery means.

DESCRIPTION OF THE PREFERRED EMBODIMENT

Figure 1:
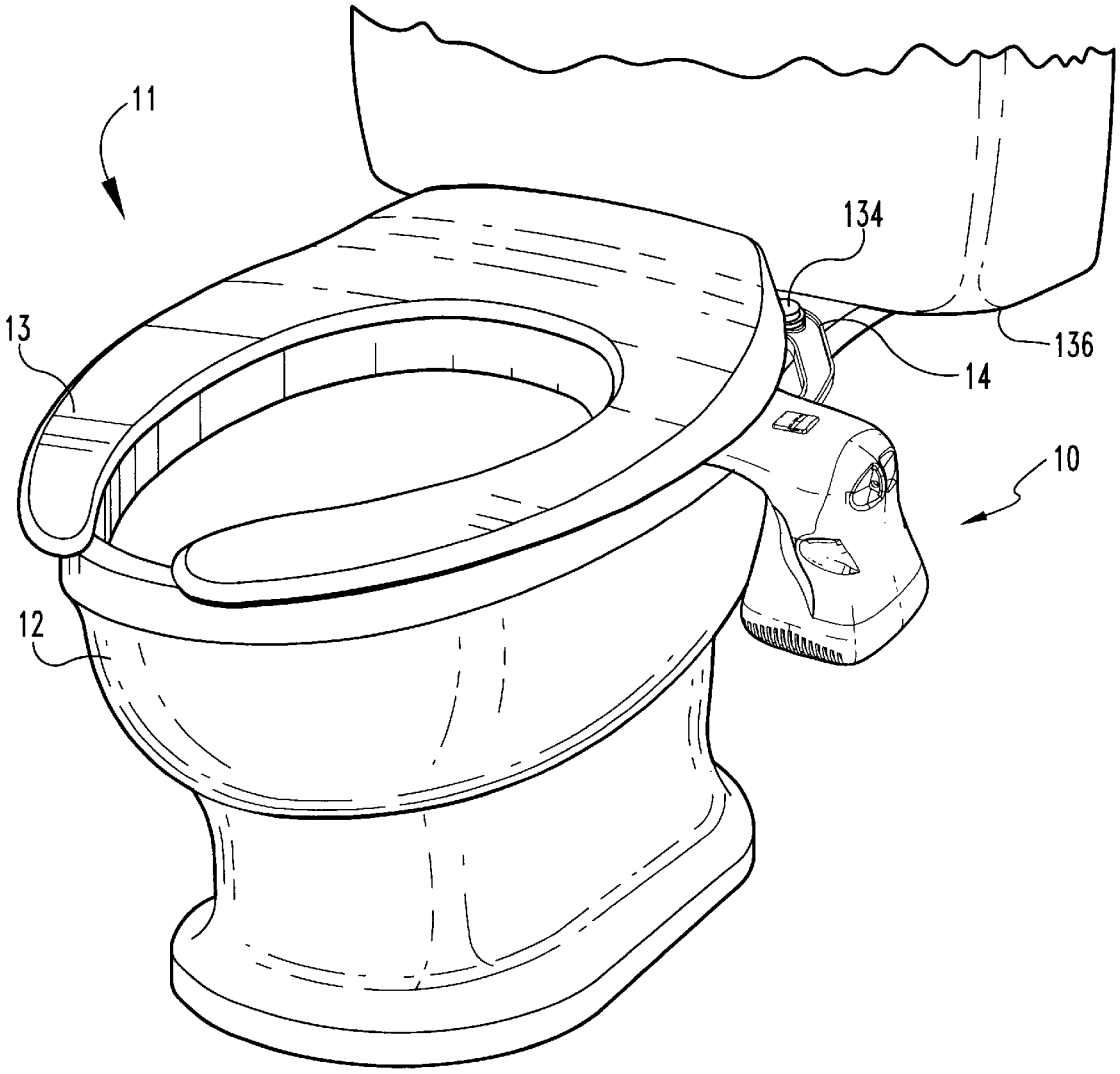
FIG. 1 is a perspective view of an apparatus 10 for treating objectionable odors in toilet bowls and the like in accordance with the preferred embodiment of the present invention, apparatus 10 shown mounted to a standard toilet 11.
Figure 2:
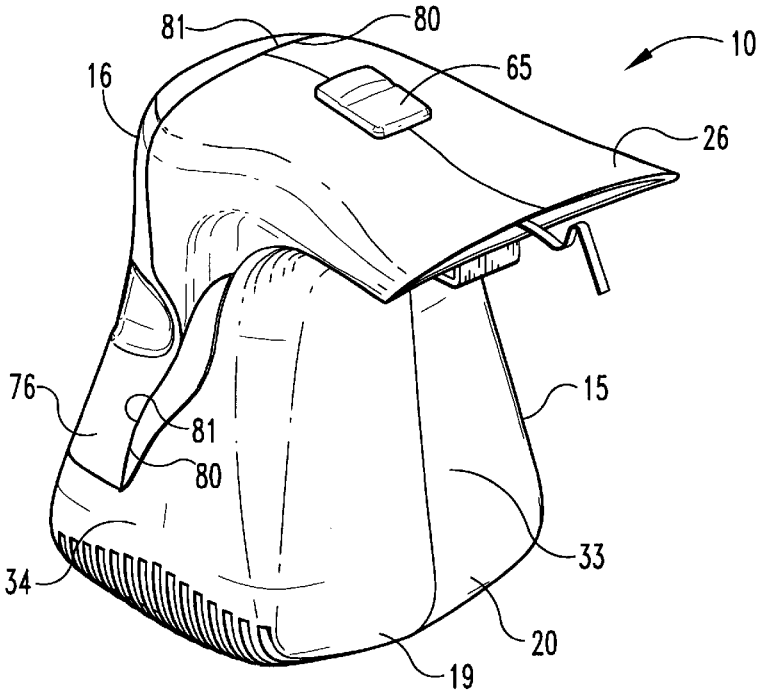
FIG. 2 is a front and side, perspective view of the apparatus 10 of FIG. 1.
Figure 3:
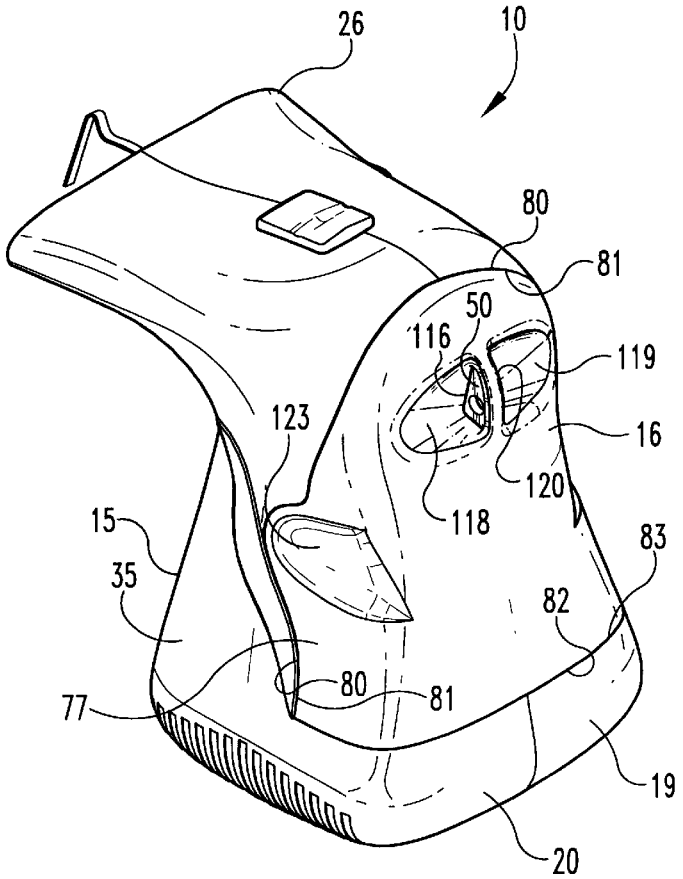
FIG. 3 is a rear and side, perspective view of the apparatus 10 of FIG. 1.
Figure 4:
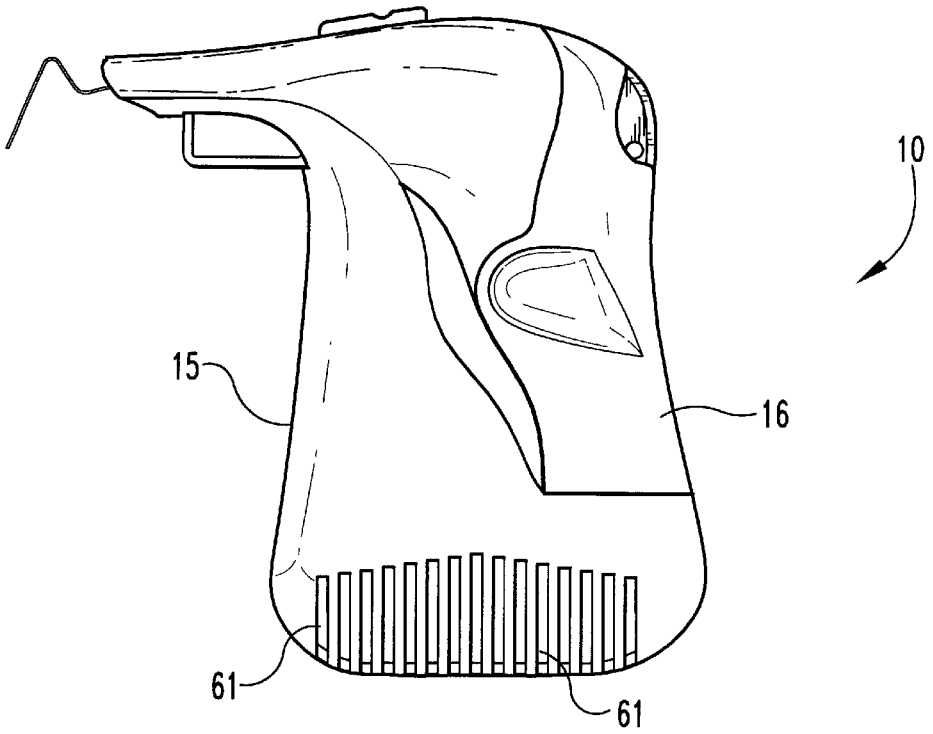
FIG. 4 is a side view of the apparatus 10 of FIG. 1.
Figure 5:
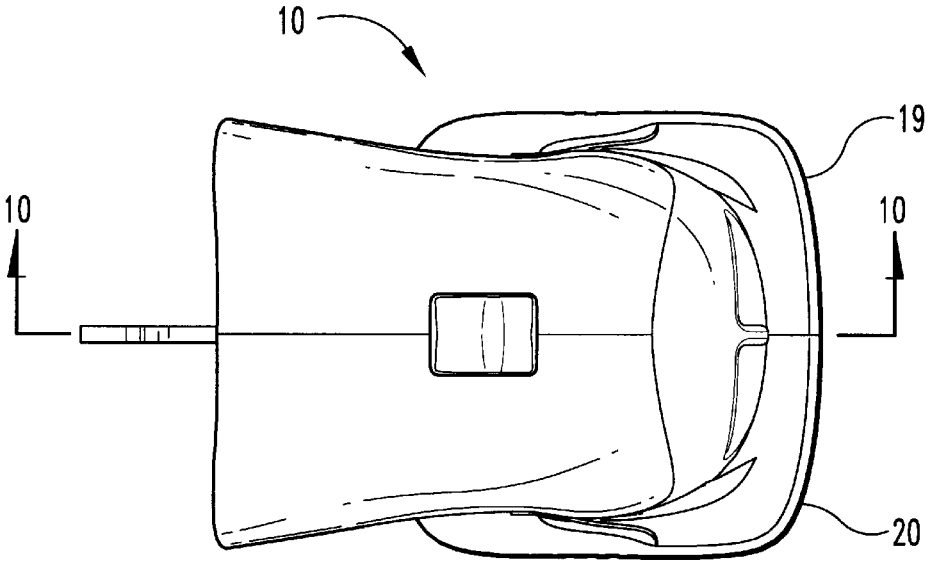
FIG. 5 is a top view of the apparatus 10 of FIG. 1.
Figure 6:
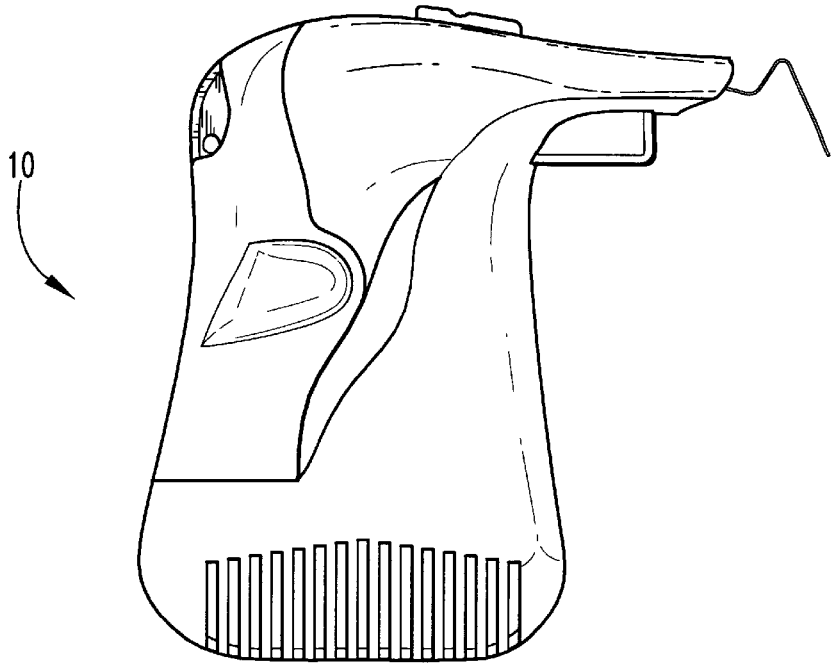
FIG. 6 is a side view of the apparatus 10 of FIG. 1
Figure 7:
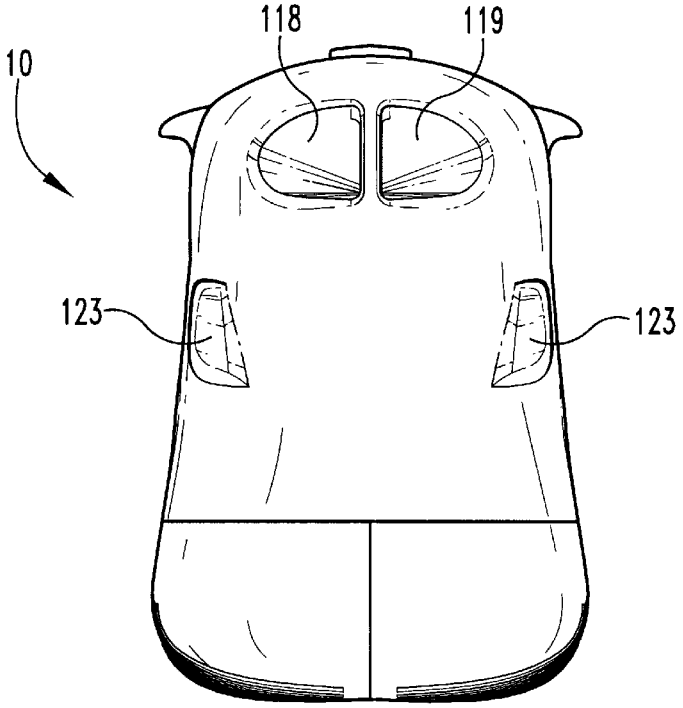
FIG. 7 is a rear view of the apparatus 10 of FIG. 1.
Figure 8:
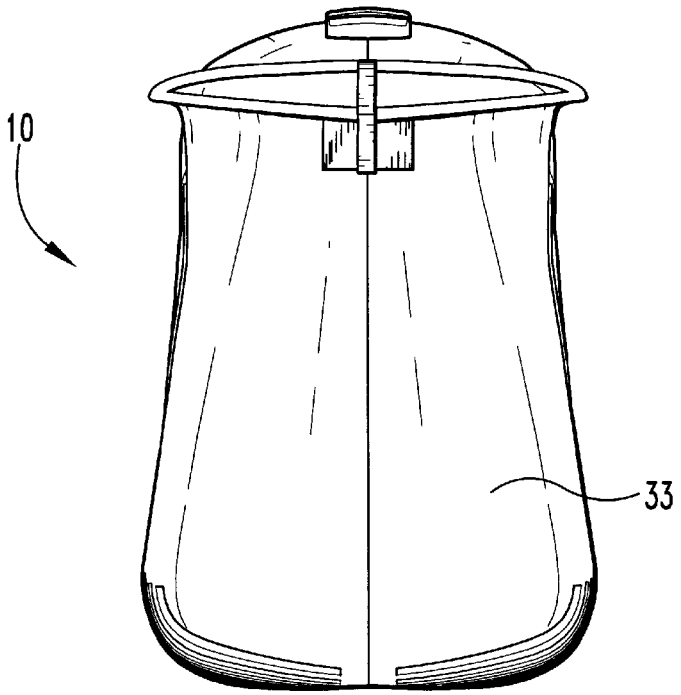
FIG. 8 is a front view of the apparatus 10 of FIG. 1.
Figure 9:
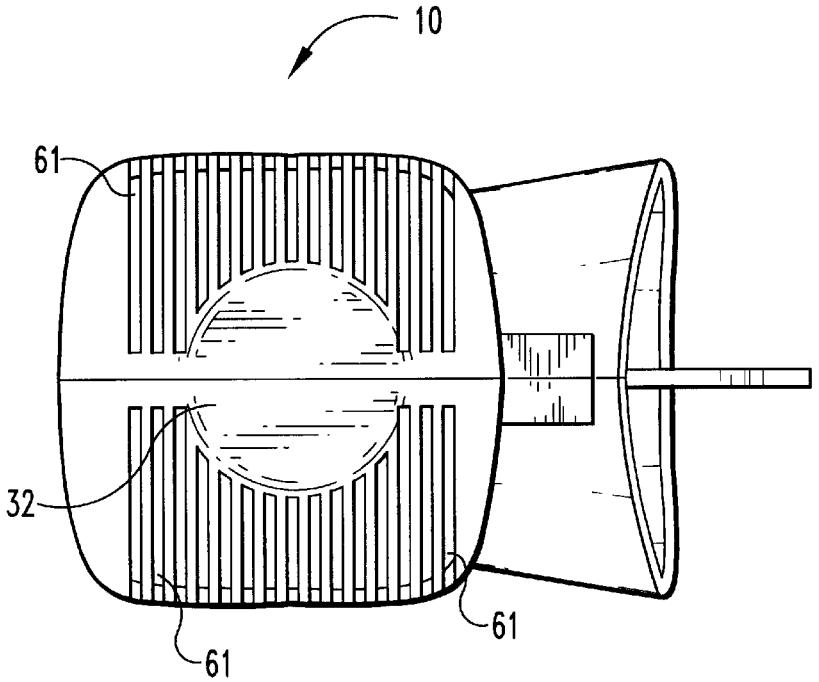
FIG. 9 is a bottom view of the apparatus 10 of FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Referring to FIG. 1, there is shown an apparatus 10 for treating and eradicating objectionable odors from toilet bowls and the like in accordance with the preferred embodiment of the present invention. Apparatus 10 is shown in use mounted to a standard toilet 11 by a mounting arm 14 to draw gases from within the toilet bowl 12, between the toilet bowl 12 and its seat 13, and to treat such gases, as described herein.

Figure 10:
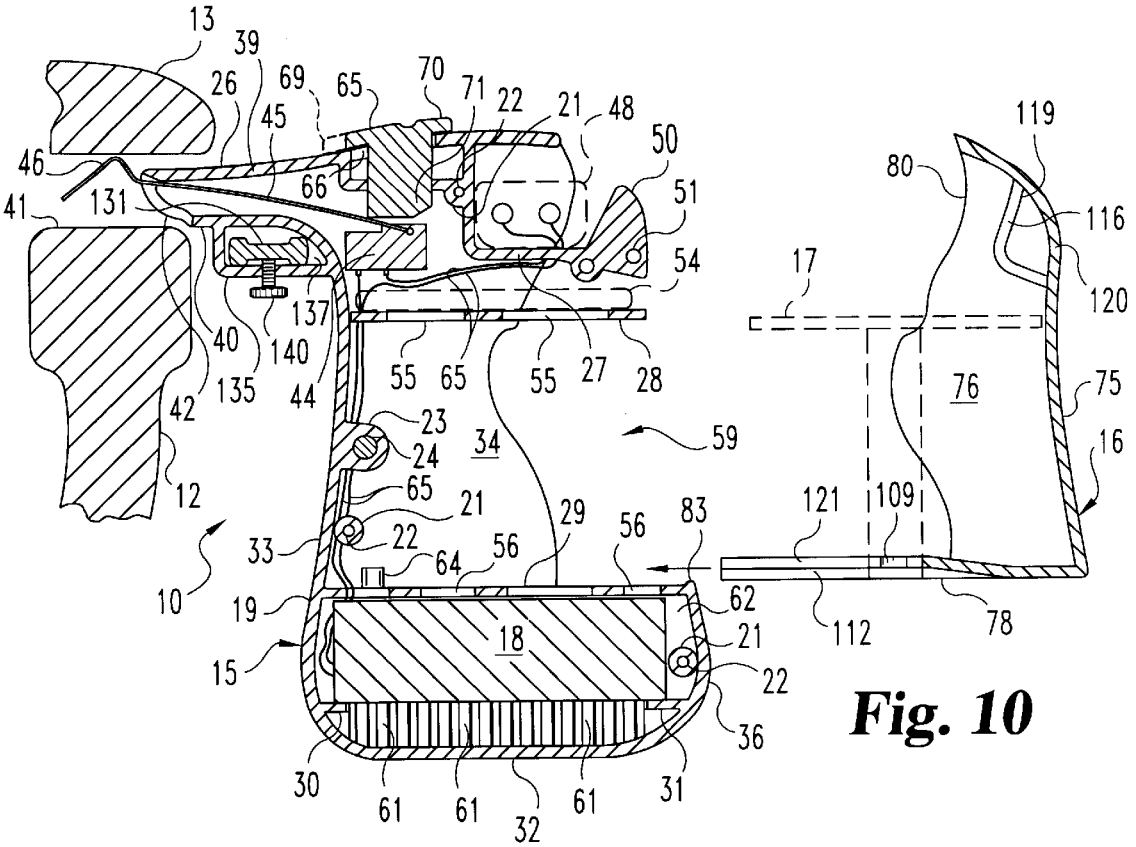
FIG. 10 is a side, cross-sectional view of the apparatus 10 of FIG. 5 taken along the lines 10—10 and viewed in the direction of the arrows, and with drawer 16 in the removed condition.
Figure 11:
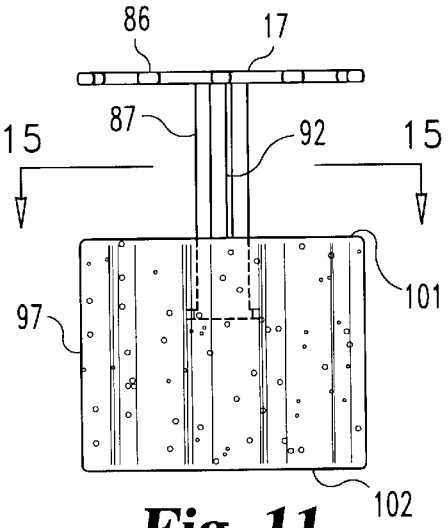
FIG. 11 is a side, elevational view of a sponge tree 17 of FIG. 10 and of a sponge 97 partially applied to sponge tree 17.

Referring to FIGS. 2–10, and with particular reference to FIG. 10, apparatus 10 is shown from a variety of angles and generally includes a main body 15, a drawer 16, a sponge tree 17 and a fan 18. Drawer 16 is configured to slide laterally from a closed condition (FIGS. 2–9) out and away from body 15 to an open or removed condition (FIG. 10). Body 15 is integrally molded into two mating body halves 19 and 20 that are mirror images of each other. Each half 19 includes structures 21 which defines holes that align with corresponding holes in the mating other half 20 when the two halves 19 and 20 are brought together. Pins 22 extend from within the holes of one half 19 and into the corresponding, aligned holes of the other half 20 to fix halves 19 and 20 in the desired mutual alignment to form main body 15, substantially as shown in FIGS. 2–9. Similarly, mutually aligned structures 23 in both halves 19 and 20 receive an appropriate securing member such as a nut and bolt combination 24 to fix the halves 19 and 20 together. Although the present embodiment describes main body 15 comprising two mirrored halves, the present invention contemplates manufacturing main body in a variety of different ways including, but not limited to, a unibody construction or two or more parts connected with each other in any appropriate manner, so long as the resulting structure includes the primary elements described herein. As halves 19 and 20 of the present embodiment are mirror images of each other, the following description may be made with reference to only body half 19, it being understood to apply equally to body half 20, unless otherwise stated.

Main body 15 includes an upper inlet spout 26, a battery shelf 27, a filter shelf 28, a drawer compartment shelf 29, opposing front and back fan support ledges 30 and 31, respectively, bottom wall 32, front wall 33, opposing side walls 34 and 35, and rear wall 36. Upper inlet spout 26 extends forwardly from front wall 33, and itself has top and bottom walls 39 and 40 that define a generally low profile inlet spout that diverges as it extends forwardly from front wall 33 to its wide and low-profile opening 42. Apparatus 10 is to be positioned at toilet bowl 12 with the widening, low profile spout structure positioned at or between the top 41 of bowl 12 and the corresponding toilet seat 13. The widened inlet opening 42 facilitates an unrestricted draw of gases from bowl 12.

An electrical switch 44 is mounted by appropriate means such as screws (not shown) to body 15. A spring metal activation arm 45 extends from switch 44, through spout 26, out opening 42, and forwardly of spout 26. With apparatus 10 in its inactivated and rest condition (as shown in FIG. 10), a hump 46 defined at the forward end of activation arm 45 extends a predetermined amount above top wall 39, as shown. As discussed herein, when weight is applied to seat 13, seat 13 will move downwardly slightly, toward toilet bowl 12, just enough to depress activation arm 45 at hump 46, which action will pivot arm 45 at switch 44 to activate switch 44. Battery shelf 27 is sized to receive a battery 48 thereon. Extending rearwardly of battery shelf 27 and at the lateral center thereof is a shaped, vertically extending flange 50 which defines a hole 51 therein.

Filter shelf 28 is juxtaposed a sufficient distance below battery shelf 27, flange 50 and switch 44 to receive a filter 54 thereon. Filter 54 has a wafer shape and is made of any appropriate material that removes odiferous particulates from a gas that flows through such material. In one embodiment, filter 54 is made of a charcoal-based, fibrous material. Filter 54 may be positioned, and thus changed from time to time, simply by sliding it in and onto shelf 28 from the rear of main body 15 when drawer 16 is removed from main body 15 (FIG. 10). Filter shelf 28 is not a solid sheet, but rather defines one or more openings 55 therein to minimize any restriction to fluid flow therethrough. The number and size of such openings 55 may vary as desired, but it is desired to minimize obstruction to fluid flow from one side of filter shelf 28 to the other, and it is therefore desired to maximize the total lateral area of openings 55 while simultaneously providing a stable platform for supporting filter 54. Likewise, drawer compartment shelf 29 defines one or more openings 56 therein to permit unrestricted fluid flow from one side of shelf 29 to the other, and its is similarly desired to minimize obstruction to such fluid flow, and therefore desired to maximize the total lateral area of openings 56. Drawer compartment shelf 29 contributes to the support of drawer 16 and, together with filter shelf 28, front wall 33, side walls 34 and 35, and drawer 16, defines sponge chamber 59.

Extending inwardly from front and rear walls 33 and 36 are fan support ledges 30 and 31, respectively. A fan 18 is supported upon ledges 30 and 31 within fan chamber 62, fan chamber 62 being defined by drawer compartment shelf 29, bottom wall 32, and front, side and rear walls 33–36. A series of vent slots 61 are defined in bottom wall 32 and extend slightly upward along side walls 34 and 35. Fan 18 is any appropriate fan unit which preferably provides a high fluid flow rate is efficiently powered by battery 48, and is relatively quiet. Fan 18 has an upwardly disposed flow inlet to communicate with the openings 56 in drawer compartment shelf 29 and has a downwardly disposed flow exhaust to communicate with vent slots 61. In the present embodiment, fan 18 is positioned upon ledges 30 and 31 of one body half 19 and is secured within fan chamber 62 upon securing body halves 19 and 20 together. In the assembled condition, with body halves 19 and 20 secured together, battery shelf 27, filter shelf 28, drawer compartment shelf 29 and ledges 30 and 31 extend all the way across main body 15, side wall 34 to side wall 35. An arcuate projection 64 juts inwardly from side wall 34 a similar projection (not shown) juts inwardly from mating side wall 35. Projection 64 is sized to register with a complementary shaped recess in drawer 16.

A thumb switch 65 slides within a slot 66 defined in spout 26 between a forward "on" position (shown in phantom at 69) and a rearward "off" position 70. A downwardly projecting lug 71, extending downwardly from switch 65, moves in and out of engagement with activation arm 45 when thumb switch 65 is moved between the on and off positions. That is, when switch 65 is slid forward to the on position 69, projection 71 engages and pushes arm 45 downwardly at a point close to the connection of arm 45 to switch 44. Further pivoting of arm 45, as by weight being applied to seat 13, will apply sufficient additional torque to arm 45 to close switch 44. Conversely, sliding switch 65 to the off position releases the downward bias to arm 45 at switch 44 which disengages switch 44. That is, because activation arm 45 is made of spring metal or a similar material which allows it to bend somewhat over its length, pivoting of activation arm 45 by applying downward pressure to hump 46 will not transmit sufficient torque through arm 45 to switch 44 to close switch 44 and turn on fan 18 when thumb switch 65 is in the off position. The present invention contemplates the use of any appropriate switch arrangement where a switch may be closed by the slight movement of a member like activation arm 45, but where closure of the switch may be overridden by another switch such as thumb switch 65. Wires 65 extend among switch 44, battery 48 and fan 18 to complete the circuit and power fan 18 when switch 44 is closed.

An alternative embodiment is contemplated wherein thumb switch 65 acts to turn on fan 18 even where there is no input from activation arm 45. That is, when switch 65 is in the "off" position, activation arm 45 may operate as described to engage switch 44 and activate fan 18. However, where a child or very lightweight person is too light, perhaps, to activate arm 45, in view of the composition of seat 13 when sitting on seat 13, thumb switch 65 may be slid to the "on" position to activate switch 44 and turn on fan 18. Another embodiment is contemplated wherein thumb switch 65 may be connected with switch 44 and/or arm 45 to move from an "off" position, completely disabling fan 18, an "on" position, turning on fan 18 and overriding activation arm 45, and an intermediate or "seat" position whereby activation arm 45 is operable through switch 44, to activate fan 18 between on and off positions.

Referring now to FIGS. 2–15, and particularly to FIGS. 2, 3 and 10–15, drawer 16 includes rear wall 75, opposing side walls 76 and 77 and sponge shelf 78. The forwardly facing edge 80 of drawer 16 has a contour that is complementary with the rearwardly facing edge 81 of main body 15, and the lower edge 82 of rear wall 75 has a contour that is complementary with upper edge 83 of rear wall 36 of main body 15. Drawer 16 may therefore be slidingly received by main body 15 from the open or removed condition (FIG. 10) to the closed condition (FIGS. 2–9), whereby edges 80 and 81 and edges 82 and 83 come into complete abutting alignment and sponge shelf 78 slides along and atop drawer compartment shelf 29.

Figure 14:
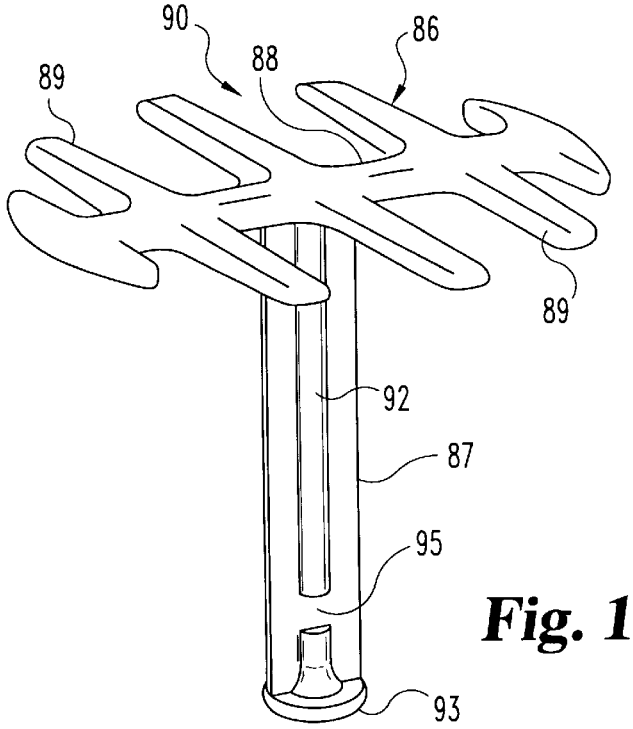
FIG. 14 is a perspective view of sponge tree 17 of FIG. 11.

Sponge tree 17 has the configuration as generally shown in FIG. 14 with an upper retaining wall 86 and a central post 87 depending downwardly from the center thereof. Retaining wall 86 comprises a central spine 88 and a series of spaced apart legs 89 extending outwardly therefrom. Spine 88 and legs 89 together define both an upper retaining wall for a sponge and a compression platform that may be used to assist in rinsing out such sponge, as will be described herein. Spine 88 and legs 89 have a generally circular cross section in plan view which is approximately equal to or slightly smaller than the dimensions of filter shelf 28 so that retaining wall 86 will fit within sponge chamber 59 just below filter shelf 28. Spine 88 and outwardly extending legs 89 define a series of gaps 90 therebetween which permits fluid flow therethrough. As with filter shelf 28 and drawer compartment shelf 29, spine 88 and legs 89 are configured to maximize the fluid flow rate through gaps 90 while still providing sufficient strength to withstand a downwardly applied compression force for assembling apparatus 10 and changing or cleaning the corresponding sponge.

Central post 87 has a generally flat, rectangular configuration in cross-section with arcuate longitudinal humps 91 and 92 extending outwardly from opposing sides of post 87 and all along the length of post 87, from upper retaining wall 86 and down to the base 93 of post 87, except for a small gap 95 where humps 91 and 92 are absent. That is the absence of a section of each hump 91 and 92 on opposing sides of post 87 defines one gap of 95 at the lower section of each hump 91 and 92. The gaps 95 are located the same distance up from base 93. Base 93 has a generally circular cross section with a diameter that is approximately equal to the width of central post 87. Arcuate, longitudinal humps 91 and 92 are together generally circular in cross-section. They may have other cross-sectional shapes, whereby the shape of the corresponding combined enlarged opening (at 109 and 110 in slot 106 as described herein) will be complementary.

A sponge 97 (FIGS. 11, 12 and 15) has a generally circular cross section in plan view with a diameter that is approximately equal to the diametrical dimensions of upper retaining wall 86. Sponge 97 has a height which is approximately equal to or slightly less than the height of central post 87. Sponge 97 defines a central hole 98, the diameter of which is preferably slightly less than the width of central post 87. Sponges are available in a wide variety of configurations, construction and degrees of porosity. Typically, the more porous the sponge, the lower its capacity to retain fluids. Although because of its inherent porosity, sponges will typically permit fluid flow, and specifically gas flow therethrough, sponge 97 is provided with a plurality of additional recesses 99 and holes 100 along its height to enhance fluid flow from its top surface 101 to its bottom surface 102. These recesses 99 and holes 100 may be defined in sponge 97 in a variety of ways including, but not limited to mechanical and chemical means. Likewise, sponge 97 may be selected from a class of sponges that inherently have a high number of both large and small openings which will facilitate a high rate of fluid flow and a sufficiently high degree of material surface area. A high degree of surface area is desirable to enable sponge 97 to be impregnated with substances having particular aromas.

Figure 12:
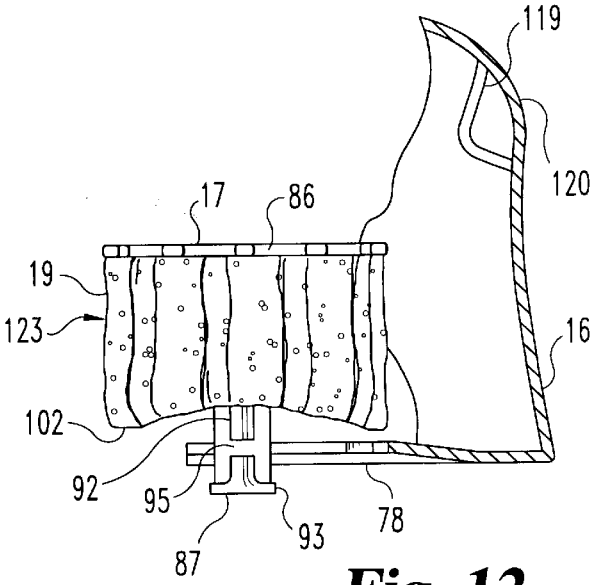
FIG. 12 is a side, cross sectional view of drawer 16 of FIG. 10 and of sponge tree 17 and sponge 97 partially mounted to drawer 16.
Figure 13:
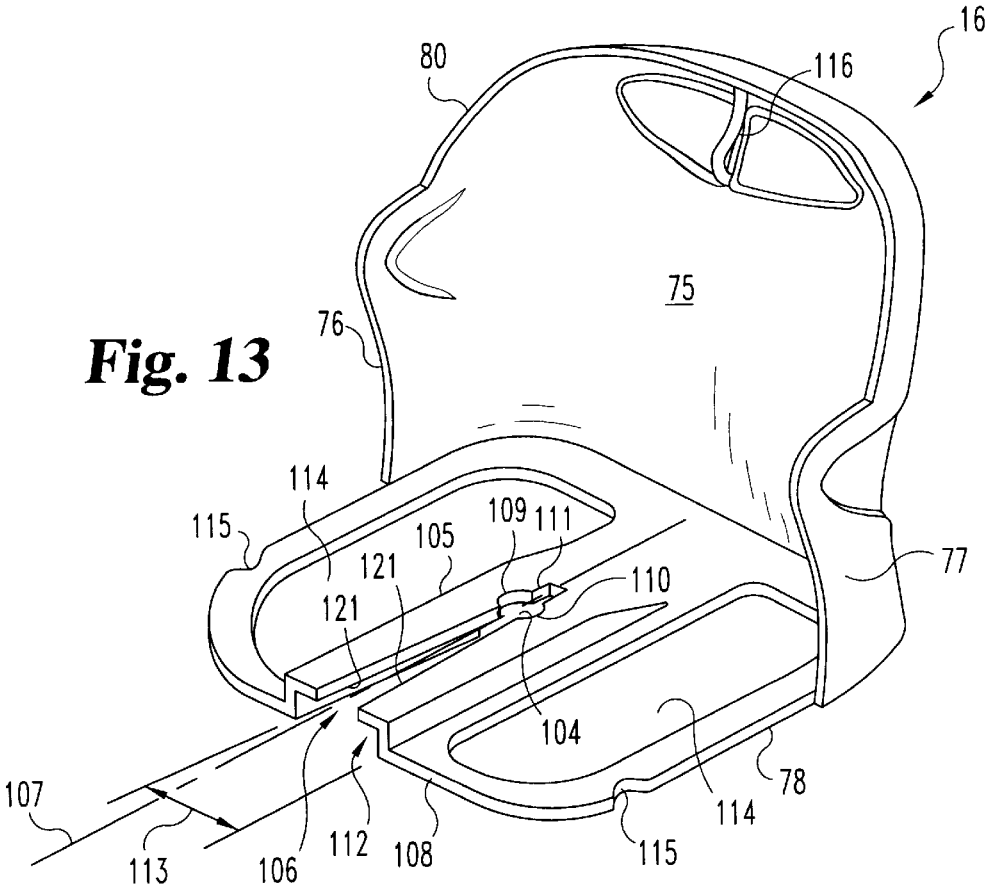
FIG. 13 is a perspective view of drawer 16 of FIG. 10.

Referring to FIGS. 12 and 13, sponge shelf 78 includes a raised central, and laterally extending platform. Platform 105 defines a slot 106 which originates somewhat rearwardly of the center of sponge shelf 78 and extends therefrom along a longitudinal axis 107 to the forward edge 108 of shelf 78. At the center of sponge shelf 78, slot 106 has a shape that is substantially identical to the cross sectional shape of central post 87 as is viewed in FIG. 15. That is, slot 106, at the center of shelf 78, bulges outwardly, in opposing directions, at 109 and 110, to define a central, enlarged opening 104. From enlarged opening 104, slot 106 extends a short distance rearwardly at and diverges as it extends toward forward edge 108. Also, platform 105 is raised slightly above the level of the rest of sponge shelf 78, thereby creating a generally rectangular shaped, lateral slot at 112 the width 113 of such slot 112 is approximately equal to or slightly greater thanthe diameter of base 93 of sponge tree 17. As with filter shelf 28, drawer compartment 29 and upper retaining wall 86, sponge shelf 78 is provided with openings 114 to permit fluid flow therethrough, the total area defined by such openings being maximized to minimizing any restriction to such fluid flow.

Sponge shelf 78 further defines a pair of inwardly extending recesses 115 on opposing sides thereof and slightly rearwardly of forward edge 108. Recesses 115 are sized and positioned to register with the mating projections 64 in main body 15. Thus, when drawer 16 is moved into its closed condition (FIGS. 2–9), sponge shelf 78 snaps into registry with projections 64 at recesses 115. Such registration between recesses 115 and projections 64 firmly holds drawer 16 in the closed position relative to main body 15.

If desired, drawer 16 may be more firmly secured to main body 16, and even locked thereto to prevent unauthorized opening of drawer 16. This is accomplished by registration between flange 50 and a complementary shaped and positioned slot 116 (FIG. 13) defined in the upper portion of rear wall 75 of drawer 16. Further, drawer 16 defines a pair of curved and generally laterally extending recesses 118 and 119 and defines a bridge 120 that follows the overall contour of rear wall 75, separates recesses 118 and 119 and is in substantial planar alignment with slot 116. When drawer 16 is moved to its closed condition, flange 50 extends through slot 116, between recesses 118 and 119 and up against the forwardly facing, underside of bridge 120. Hole 51 is exposed by virtue of recesses 118 and 119, and an appropriate locking member such as a padlock may be positioned through hole 51 and around bridge 120, thus preventing the removal of drawer 16 from main body 15.

Indentations 123 are provided on opposing sides of drawer 16 to facilitate the movement of drawer 16 relative to main body 15.

In use, sponge 97, is provided either pre-scented at purchase or may be conditioned by applying a desired scent with a commercial product such as an aerosol or pump-spray, auto or room air freshener. Sponge 97 is then applied to sponge tree 17 (FIG. 11) by inserting central post 87 through central hole 98 until the top surface 101 of the sponge 97 rests against the underside of upper retaining wall 86. Sponge 97 is then manually compressed (shown at 123 in FIG. 12) up against upper retaining wall 86, as shown in FIG. 12, so that gaps 95 in humps 91 and 92 are exposed. Sponge and sponge tree combination 97/17 is then mounted to drawer 16 by sliding central post 87 through slot 106 whereby the opposing edges 121 of slot 106 are aligned within gaps 95. When sponge and sponge tree combination 97/17 reaches the center of sponge shelf 78, and arcuate humps 91 and 92 are vertically aligned with enlarged opening 104, sponge 97 may be released from its compressed position 123, which action causes the bottom surface 102 of sponge 97 to press against sponge shelf 78. Because humps 91 and 92 are aligned with complementary shaped, enlarged opening 104, sponge tree 17 may rise relative to platform 105 until base 93 engages the underside of platform 105 and within lateral slot 112. In this configuration, the lowermost portions of are nested within complementary shaped enlarged opening 104, and sponge tree 17 may be slid vertically through opening 104 and relative to platform 105. However, because the combined lateral dimension of humps 91 and 92 is greater than the width of slot 106 adjacent to enlarged opening, sponge tree 17 is constrained from moving laterally. To remove sponge tree 17, it must be moved vertically until gaps 95 align with the edges 121 of slot 106, and then sponge tree 17 may be slid forwardly out of slot 106. With this configuration, sponge tree 17 and sponge 97 are firmly mounted within drawer 16. With an appropriate filter 54 positioned atop filter shelf 28, the drawer can now be joined with main body 15, as described herein, until edges 80 and 81 and edges 92 and 93 mate, and whereby sponge 97 will be securely positioned within sponge chamber 59, below filter shelf 28 and above drawer compartment shelf 29. Apparatus 10 is now ready for operation. Upon activation of fan 18, gases are drawn in through opening 42, through filter 54, through scented sponge 79, through fan 18, and out through vent slots 61, the ejected gases now devoid of some or much of the original objectionable odors and having a desired aroma picked up from the treated sponge 97.

The sponge tree and sponge combination 17/97 also cooperates with drawer 16 to facilitate rinsing or cleaning of the sponge and related components. Upon removal of drawer 16, and without removing sponge tree 17 from drawer 16, the drawer, sponge tree, and sponge combination 16/17/97 may be positioned appropriately under a stream of water or in a container with cleaning solution or water and appropriately cleaned or rinsed. Upon removal from such water or cleaning solution, the user may compress upper retaining wall 86 toward sponge shelf 78, whereby post 87 slides through complementary shaped slot 106 and enlarged opening 104, and sponge 97 is compressed therebetween, which action squeezes the majority of fluid from sponge 97. This procedure may be repeated as many times as necessary to clean and/or rinse sponge 97. This configuration thereby generally permits the user to clean and/or rinse sponge 97 without requiring sponge 97 to be removed from sponge tree 17 and drawer 16, and further minimizing the amount of direct contact between the users hands and sponge 97. This procedure further permits the sponge to be cleaned and/or rinsed and then for a different fragrance to be applied to sponge 97. If desired, sponge 97 may be replaced with a new sponge simply by reversing the steps for installing the sponge.

Figure 16:
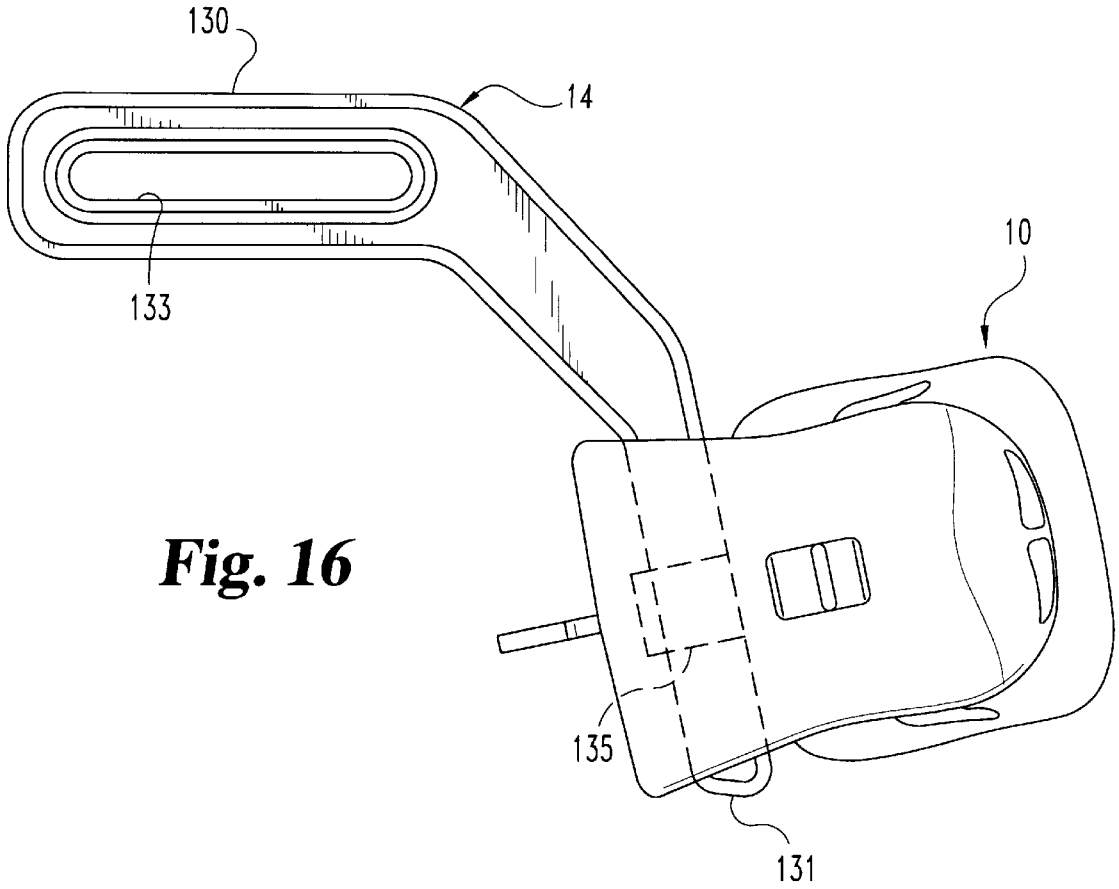
FIG. 16 is a top plan view of apparatus 10 of FIG. 1 and of mounting bracket 14.
Figure 15:
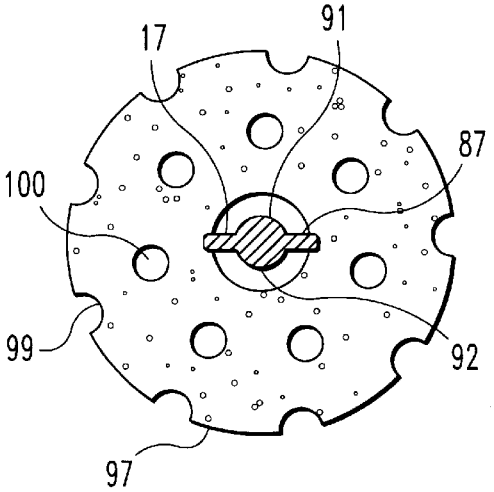
FIG. 15 is a cross-sectional view of the sponge tree 17 and sponge 97 of FIG. 11 taken along the lines 15—15 and viewed in the direction of the arrows.

Referring not to FIGS. 1 and 16, there is shown a support arm 14 suitable for mounting apparatus 10 to a standard toilet bowl 12. Apparatus 14 includes at one end an inboard mounting section 130 and extends through a pair of bends to an outboard mounting section 131 at the opposite end. Inboard mounting section 130 is provided with an elongate slot 133 that is sized to receive a standard toilet seat mounting bolt 134. An L-shaped bracket 135 depends down from the bottom of upper inlet spout 26 (FIGS. 8–10) and over to front wall 33 to create, in conjunction with the underside of spout 26, an opening 137 sized to receive outboard mounting section 131 of support arm 14 therethrough. Support arm 14 is connected to toilet bowl 12 simply by removing one of the toilet seat mounting bolts 134 (and its corresponding wing nut or similar structure (not shown)) from its connection to toilet bowl 12, positioning support arm 14 atop toilet bowl 12, between toilet seat 13 and tank 136 substantially as shown in FIG. 1, and with slot 133 in alignment over the toilet seat mounting hole (not shown) of toilet bowl 12, and then extending toilet seat mounting bolt 134 through slot 133 and back through the toilet seat mounting hole. Bolt 134 is secured thereto with the corresponding wing nut (not shown). Apparatus 10 is then moved into position whereby outboard mounting section 131 extends through the opening 137 of L-shaped bracket 135. A set screw 140 extends up through bracket 135 to tighten against outboard mounting section 131, thereby firmly securing apparatus 10 to support arm 14.

Because toilets come in a variety of sizes and shapes, the slot 133 in support arm 14 allows support arm 14 to be adjusted to a variety of positions, and apparatus 10 may be slid along outboard mounting section 131, until apparatus 10 is in the desired position relative to bowl 12. Such desired position is substantially shown in FIG. 10 where inlet opening 42 is just above and to the outside of the top surface 41 of bowl 12. Because support arm 14 has a thickness and will raise one side of toilet seat 13 relative to bowl 12 when apparatus 10 is applied thereto, a washer (not shown) made of the same material as support arm 14 and having the same relative thickness as support arm 14 is contemplated for insertion between toilet bowl 12 and the other toilet seat mounting bolt (not shown) to raise that side to level. While standard toilet seats generally have cushion members (not shown) that are mounted to the underside of seat 13 to cushion the contact between seat 13 and bowl 12 when seat 13 is lowered, application of apparatus 10 to bowl 12 will still raise the rear of seat 13 from an otherwise level conditioned, and seat 13 will tilt forward. The present invention contemplates inclusion of replacement cushion members (not shown) to replace the standard cushion members, the replacement cushion members having a thickness that is sufficiently greater than the original cushion members to level out seat 13.

Support arm 14 and its companion washer, along with main body 15, drawer 16, sponge tree 17 and other components herein are made of any appropriate material such as plastic which can be easily cleaned by the user.

Alternative embodiments are contemplated wherein sponge 97 comprises other materials in other configurations, such other materials and configurations being capable of holding a scented material, or comprising a scented material, which can be released into a surrounding gaseous atmosphere. For example, such other materials and configurations include, but are not limited to, the wide variety of solid air fresheners currently available or to be available in the future. Thus, while the present embodiment describes the scent delivering apparatus as a sponge 97, such scent delivering apparatus is intending to include any material that releases a desired scent into the fan-induced air flow. Where sponge 97 is to be replaced by a solid air freshener, sponge tree 17 is removed from drawer 16 and the solid air freshener is placed directly atop sponge shelf 78. Alternative embodiments are contemplated wherein a solid air freshener is provided with a central tree similar to sponge tree 17 with an appropriate lower shape and configuration that mates with a complementary configuration in sponge shelf 78 to facilitate the insertion of such solid air freshener into drawer 16 without the user having to physically touch the air freshener material.

The present invention contemplates alternative means for mounting apparatus 10 proximal to toilet bowl 12. Support arm 14 is believed to be preferable since it is simple, cost-efficient, easy to use, and incorporates the structure of the standard toilet bowl. However, alternative structures are contemplated so long as inlet opening 42 is positioned as close to the gap between bowl 12 and seat 13 as possible to maximize the draw of gases from within bowl 12. That is, apparatus 10 will naturally draw gases from both inside bowl 12 and from the atmosphere outside of bowl 12 (unless the gap between bowl 12 and seat 13 is completely sealed off except for apparatus 10). The farther that apparatus 10 is positioned from bowl 12 and seat 13, the lower the percentage of toilet bowl gases that will be drawn through apparatus 10 and the less effective apparatus 10 will be. Support arm 14 permits a varied adjustment of the position of apparatus 10 relative to the bowl/seat gap, thereby enabling maximum effectiveness of apparatus 10.

Alternative embodiments are also contemplated wherein apparatus 10, having a generally flat bottom wall 32, may be used at locations other than the bathroom toilet merely by sitting apparatus 10 upon an appropriate surface.

While the invention has been illustrated and described in detail in the drawings and foregoing description, the same is to be considered as illustrated and not restrictive in character, it being understood that only the preferred embodiment has been shown and described and that all changes and modifications that come within the spirit of the invention are desired to be protected.

What is claimed is:

1. An apparatus for treating objectionable odors in a toilet bowl, the toilet bowl including a seat positioned above the toilet bowl, the apparatus comprising:

a main body having an inlet opening, an outlet opening and a scent delivery chamber;

means for mounting said main body proximal to the toilet bowl with the inlet opening positioned substantially between the bowl and the seat;

a drawer removably securable to said main body, said drawer being sized and shaped for lateral sliding opening and closing movement within a complementary shaped opening defined in said main body;

fan means for drawing gas in the inlet opening, through the scent delivery chamber and out the outlet opening;

a power source;

a switch for electrically connecting said power source to said fan means;

a scent delivery means positioned within the scent delivery chamber for releasing a scent at least when said fan means is drawing gas through the scent delivery chamber; and wherein said drawer includes a closed condition securing said scent delivery means within the scent delivery chamber, and an open condition exposing and enabling removal of said scent delivery means.

2. The apparatus for treating objectionable odors in a toilet bowl of claim 1 wherein said switch includes switch means wired with said fan means and said power source and engagable with the toilet seat to cause electrical connection between said power source and said fan means upon downward pressure being applied to the toilet seat relative to the toilet bowl.

3. The apparatus for treating objectionable odors in a toilet bowl of claim 1 wherein said scent delivery means includes a sponge.

4. The apparatus for treating objectionable odors in a toilet bowl of claim 3 further including a sponge tree for holding said sponge in a desired position within the scent delivery chamber.

5. The apparatus for treating objectionable odors in a toilet bowl of claim 4 wherein said sponge tree is mountable to said drawer whereupon said drawer, sponge tree and sponge move as a unit between the closed condition and the open condition.

6. The apparatus for treating objectionable odors in a toilet bowl of claim 5 wherein said drawer includes structure shaped and sized to slidably receive said sponge tree along a first path, said sponge tree being slidable along said first path between a mounted position and a removed position.

7. The apparatus for treating objectionable odors in a toilet bowl of claim 6 wherein said sponge tree includes structure shaped and sized to slidably receive said sponge tree along a second path, said sponge tree being slidable along said second path between the mounted position and a sponge compressing position.

8. The apparatus for treating objectionable odors in a toilet bowl of claim 7 wherein the sponge has a relaxed height, wherein said sponge tree includes a retaining wall and said drawer includes a sponge shelf, wherein the mounted position includes the sponge being disposed between the retaining wall and the sponge shelf.

9. The apparatus for treating objectionable odors in a toilet bowl of claim 8 wherein the sponge compressing position includes the sponge being compressed between the retaining wall and the sponge shelf to a height considerably less than its relaxed height.

10. An apparatus for treating objectionable odors in a toilet bowl, the toilet bowl including a seat positioned above the toilet bowl, the apparatus comprising:

a main body having an inlet opening, an outlet opening and a scent delivery chamber;

means for mounting said main body proximal to the toilet bowl with the inlet opening positioned substantially between the bowl and the seat;

a drawer removably securable to said main body;

fan means for drawing gas in the inlet opening, through the scent delivery chamber and out the outlet opening;

a power source;

a switch for electrically connecting said power source to said fan means;

scent delivery means positioned within the scent delivery chamber for releasing a scent at least when said fan means is drawing gas through the scent delivery chamber;

a tree sized and shaped to hold said scent delivery means within the scent delivery chamber; and, wherein said drawer includes a closed condition securing said scent delivery means within the scent delivery chamber, and an open condition exposing and enabling removal of said scent delivery means.

11. The apparatus for treating objectionable odors in a toilet bowl of claim 10 wherein said scent delivery means includes a sponge and wherein said tree is a sponge tree configured to receive and hold said sponge in a desired position within the scent delivery chamber.

12. The apparatus for treating objectionable odors in a toilet bawl of claim 11 wherein said sponge tree is mountable to said drawer whereupon said drawer, sponge tree and sponge move as a unit between the closed condition and the open condition.

13. The apparatus for treating objectionable odors in a toilet bowl of claim 12 wherein said drawer includes structure shaped and sized to slidably receive said sponge tree along a first path, said sponge tree being slidable along said first path between a mounted position and a removed position.

14. The apparatus for treating objectionable odors in a toilet bowl of claim 13 wherein said sponge tree includes structure shaped and sized to slidably receive said sponge tree along a second path, said sponge tree being slidable along said second path between the mounted position and a sponge compressing position.

15. The apparatus for treating objectionable odors in a toilet bowl of claim 14 wherein the sponge has a relaxed height, wherein said sponge tree includes a retaining wall and said drawer includes a sponge shelf, wherein the mounted position includes the sponge being disposed between the retaining wall and the sponge shelf.

16. The apparatus for treating objectionable odors in a toilet bowl of claim 15 wherein the sponge compressing position includes the sponge being compressed between the retaining wall and the sponge shelf to a height considerably less than its relaxed height.

17. The apparatus for treating objectionable odors in a toilet bowl of claim 10 wherein said tree includes an upper retaining wall and central post depending downwardly therefrom.

18. The apparatus for treating objectionable odors in a toilet bowl of claim 17 wherein the upper retaining wall comprises a central spine and a series of spaced apart legs extending outwardly therefrom.

19. The apparatus for treating objectionable odors in a toilet bowl of claim 17 wherein said delivery means includes a sponge having a central opening sized to receive the central post therein.

20. The apparatus for treating objectionable odors in a toilet bowl of claim 17 wherein the drawer defines a slot sized to receive the central post therein, said central post having at least one longitudinal hump extending outwardly therefrom and said slot defining an enlarged opening sized to receive the hump and guide said tree along a desired path with respect to said drawer.

* * * * *